US005425671A

United States Patent [19]

Cunning

[11] Patent Number: 5,425,671

[45] Date of Patent: Jun. 20, 1995

[54] WINDOW FAN

[75] Inventor: Joseph M. Cunning, Cohasset, Mass.

[73] Assignee: Holmes Products Corp., Milford, Mass.

[21] Appl. No.: 117,572

[22] Filed: Sep. 7, 1993

[51] Int. Cl.[6] ..... F24F 7/013

[52] U.S. Cl. ..... 454/209; 454/200; 454/208

[58] Field of Search ..... 454/200, 204, 205, 208, 454/209, 210

[56] References Cited

U.S. PATENT DOCUMENTS

| | | | |
|---|---|---|---|
| D. 179,726 | 2/1957 | Harpman . | |
| 547,996 | 10/1895 | Iliowizi . | |
| 957,680 | 5/1910 | Johanns . | |
| 1,081,195 | 12/1913 | Austin . | |
| 1,307,449 | 6/1919 | Mayeda . | |
| 2,294,664 | 9/1942 | Hubbard | 454/204 |
| 2,373,497 | 4/1945 | Paiste, Jr. . | |
| 2,661,895 | 12/1953 | Frick | 454/208 X |
| 2,787,207 | 4/1957 | Moore . | |
| 2,805,820 | 9/1957 | Evarts . | |
| 2,985,092 | 5/1961 | Gamache | 454/209 |
| 3,048,095 | 8/1962 | MacLeod | 454/204 |
| 3,275,224 | 9/1966 | Bush . | |
| 3,830,147 | 8/1974 | Weber et al. . | |
| 4,838,151 | 6/1989 | Shin-Chin . | |
| 5,190,496 | 3/1993 | Shin-Chin . | |

*Primary Examiner*—Harold Joyce
*Attorney, Agent, or Firm*—Kriegsman & Kriegsman

[57] ABSTRACT

A window fan which can easily installed in a window opening without requiring the use of extraneous tools or mounting hardware. In one embodiment, the window fan comprises a housing, the housing is generally box-like in shape and is dimensioned for use with virtually any double-hung window. Disposed within the housing is a fan unit comprising a motor and a propeller-like blade rotatably mounted on the motor. The top portion of the housing is shaped to include a lip and, in addition, is shaped to include an elongated, recessed tray which extends transversely below the lip. A C-shaped clip, having a tab adapted to engage the opposite side of a closed window, is movably mounted along the longitudinal axis of the tray and includes a pair of outwardly-extending, spring arms which arc adapted to matingly engage alternative, spaced-apart sets of grooves formed on opposing side walls of the tray for use in locking the clip at specific locations within the tray.

14 Claims, 8 Drawing Sheets

WINDOW FAN

BACKGROUND OF THE INVENTION

The present invention relates generally to window fans and more particularly to a new and novel window fan.

Various types of window fans which utilize an electric motor and a fan driven by the motor for moving air in, out and/or around an enclosed space are well known. Quite frequently, special tools and mounting hardware, such as brackets, screws, and the like, are required to securely mount the window fan in a desired window opening.

In commonly-assigned Shin-Chin U.S. Pat. No. 5,190,496, which issued Mar. 2, 1993, there is disclosed a window fan which can be mounted in a window opening in either a double-hung window frame or a vertical slider window frame and which can be held securely in place without the use of additional hardware or mounting brackets. The window fan comprises a housing of generally rectangular shape, the housing including a front piece, a back piece and a pair of side extensions. The side extensions have outer edges sized and shaped to fit within the left and right side railings of a vertical slider window. Each one of the side extensions includes a pair of outer guides and a plurality of panels telescopically mounted within the outer guides. The side extensions extend out front the sides of the housing at about the rear edge so as to permit installation in windows having outer screens. A plurality of locking mechanisms are provided which, when in the closed position, keep the extenders locked at a desired extension and which, when in the open position, permit a ratchet-type extension or compression of the extenders. A pair of fan units are disposed within the housing in front of the back piece, the fan units having electrically reversible motors which are independently controllable so that either both fans can be used to intake air or to exhaust air or so that one fan unit can be used to intake air while the other fan unit is being used to exhaust air.

In commonly-assigned Shin-Chin U.S. Pat. No. 4,838,151, which issued Jun. 13, 1989, there is disclosed a fan which can be mounted in a window opening without using any tools, mounting hardware or special brackets or which can be used as a floor fan. The fan includes a pair of panel sections which are interconnected by a pair of hinge joints for pivotal movement relative to each other from a fully open position to a folded position. One of the hinge joints includes a mechanism for automatically snap-locking the two panel sections when they are at the fully open position at an angle of about 120 degrees. A pair of adjustable and lockable side extensions are provided, one attached to and extending out from each panel sections. A fan unit which includes a motor driven fan is pivotally attached to the panel sections for rotational movement relative thereto.

Other patents and publications of interest include U.S. Pat. Nos. 4,341,151, 4,222,318, 3,830,147, 3,019,718, 2,857,095, 2,805,820, 2,787,207, 2,733,002, 2,715,495, 2,580,663, 2,529,040, 2,373,497, 1,081,195, 1,307,449, 957,680, 547,996, Des. 179,726 and Australian Patent No. 235,520.

SUMMARY OF THE INVENTION

It is an object of the present invention to provide a new and novel window fan.

It is another object of the present invention to provide a window fan that can be securely and removably mounted within a window opening without requiring the use of any extraneous tools, mounting hardware or the like.

It is still another object of the present invention to provide a window fan that can be mass produced and assembled easily.

Additional objects of the invention, as well as features and advantages thereof, will be set forth in part in the description which follows, and in part will be obvious from the description or may be learned by practice of the invention. The objects of the invention also may be realized and attained by means of instrumentalities and combinations particularly pointed out in the appended claims.

In accordance with the purpose of the present invention as broadly set forth herein, a window fan constructed according to the teachings of the present invention is provided herein which comprises (a) a housing, said housing being appropriately dimensioned to fit within a window opening and having a lip adapted to abut one side of a window which has been closed onto said housing; (b) a fan unit mounted within said housing; and (c) a clip mounted on said housing, said clip including a tab adapted to abut the opposite side of a window which has been closed onto said housing, said tab being movable to a locked position in which the window is securely retained between said lip and said tab.

In a first preferred embodiment of the invention, the housing is generally box-like in shape and is dimensioned for use with virtually any double-hung window. Disposed within the housing is a fan unit comprising a motor and a propeller-like blade rotatably mounted on the motor. The top portion of the housing is shaped to include the above-mentioned lip and, in addition, is shaped to include an elongated, recessed tray which extends transversely below the lip. A C-shaped clip, having a tab adapted to engage the opposite side of a closed window, is movably mounted along the longitudinal axis of the tray and includes a pair of outwardly extending, spring arms which are adapted to matingly engage alternative, spaced-apart sets of grooves formed on opposing side walls of the tray for use in locking the clip at specific locations within the tray. By securing the window between the tab and the lip of the window fan, the window fan becomes securely mounted within the window opening.

In a second preferred embodiment of the invention, the housing is more elongated and streamlined in appearance and is shaped to define a central section and a pair of lateral sections. The central section is recessed relative to the lateral sections and houses a motor. Each of the lateral sections houses a centrifugal blower fan which is operatively coupled to the motor. A lip of the type broadly described above for abutting a window closed on the window fan extends longitudinally along the top of each of the lateral sections. A C-shaped clip, having a tab adapted to engage the opposite side of a closed window, is movably mounted transversely across the central section of the housing. The clip includes a pair of outwardly-extending, spring arms which move within a corresponding pair of slots formed on facing walls of the lateral sections. Spaced-apart projections engageable with the spring arms are formed in the slots for use in locking the clip at specific locations. The window fan is securely mounted in a window opening by retaining the window between the tab and the lips of the window fan. The window fan is appropriately constructed so that it may be mounted in a window opening with either its front side or its rear side facing inwardly (i.e. towards the interior of a room). In this manner, the window fan may alternatively be used as an exhaust fan or as an intake fan, depending on how it is oriented in the window opening.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like pans.

DETAILED DESCRIPTION OF PREFERRED EMBODIMENTS

Figure 1:
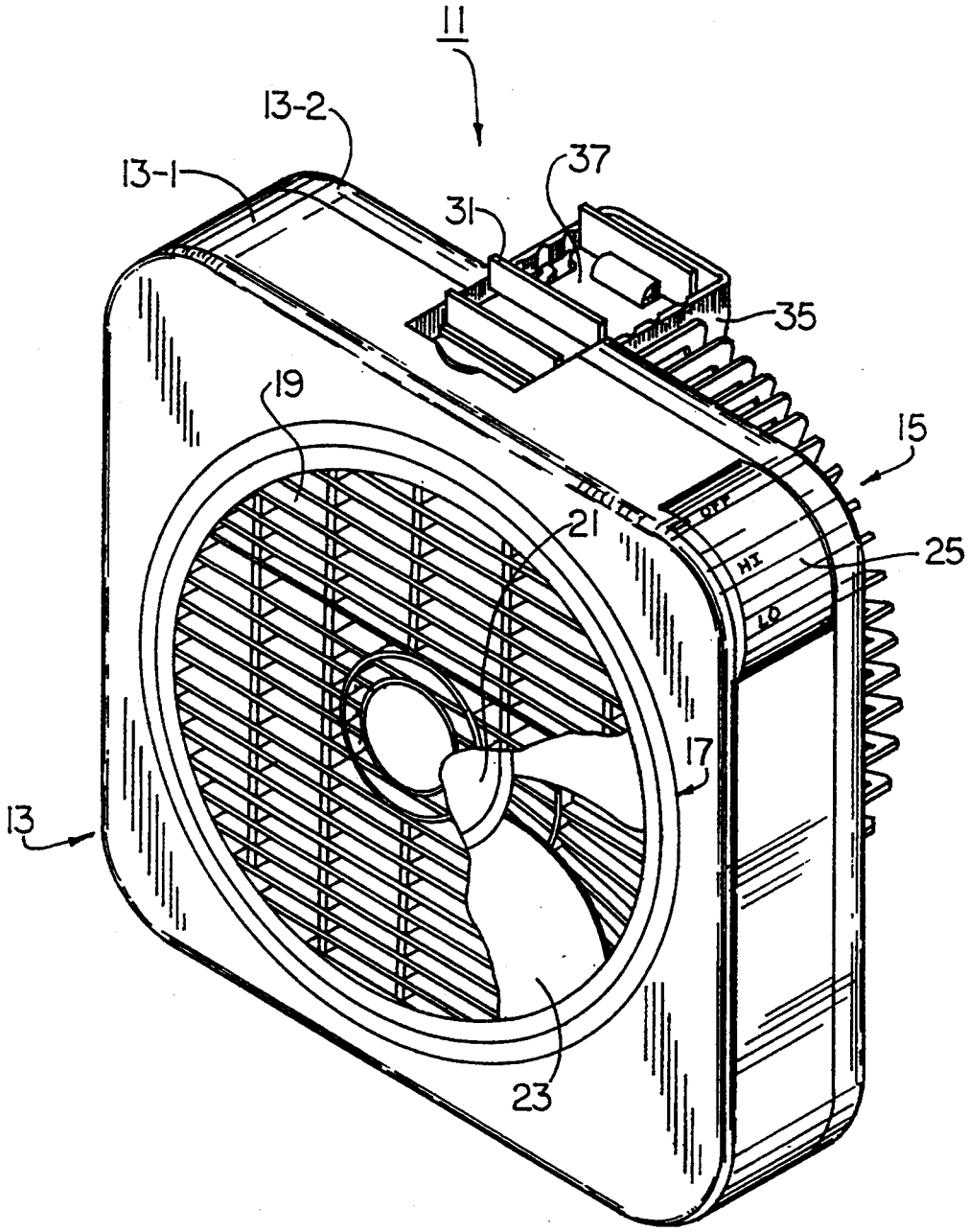
FIG. 1 is a front, right, top, perspective view, broken away in part, of a first embodiment of a window fan constructed according to the teachings of the present invention.
Figure 2:
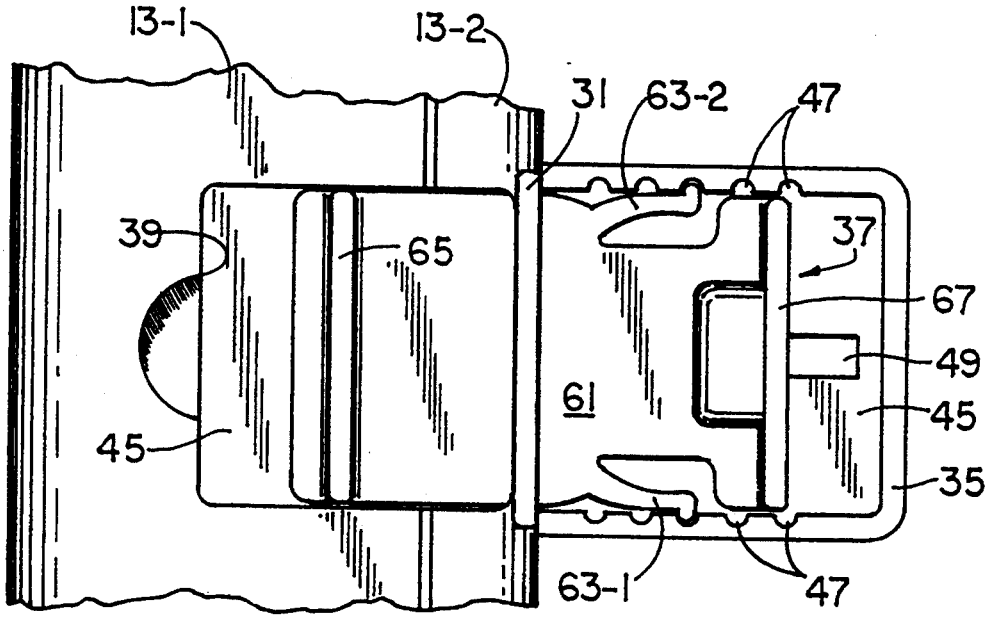
FIG. 2 is an enlarged, fragmentary, top view of the window fan of FIG. 1, illustrating the window locking mechanism.

Referring now to FIGS. 1 and 2, there are shown two different views of a first embodiment of a window fan constructed according to the teachings of the present invention, the window fan being represented generally by reference numeral 11. FIG. 1 is a front, right, top, perspective view, broken away in part, of window fan 11, and FIG. 2 is an enlarged, fragmentary, top view of window fan 11, illustrating the window locking mechanism to be discussed below.

For simplicity, those parts of window fan 11 not pertinent to the invention are not shown or discussed.

Window fan 11 comprises a housing 13. Housing 13, which is preferably made of a front piece 13-1 and a rear piece 13-2 of molded plastic secured together by screws (not shown), is generally box-like in shape and is appropriately dimensioned to fit all double-hung windows (even with a window screen remaining in place). Housing 13 is provided with an inlet opening 15 and an outlet opening 17. A manually rotatable grille 19 is removably mounted over outlet opening 17. Disposed within housing 13 are an electric motor 21 and a 6-wing, propeller-type fan blade 23 rotatably mounted on motor 21. Electricity to motor 21 is supplied by a power cord (not shown) connected in series to a three position (OFF-HI-LO) rotary switch 25 mounted flush along a top peripheral corner of housing 13. A foam-rubber strip (not shown) is adhered to the bottom of housing 13 for use in frictionally engaging window fan 11 to a desired window sill.

An integrally formed lip 31 extends longitudinally across a portion of the top of housing 13. Lip 31 is appropriately situated on the top of housing 13 so that, when window fan 11 is properly placed within a window opening and a window is closed on top of housing 13, lip 31 abuts one side of the window (typically the inside of the window).

Figure 3:
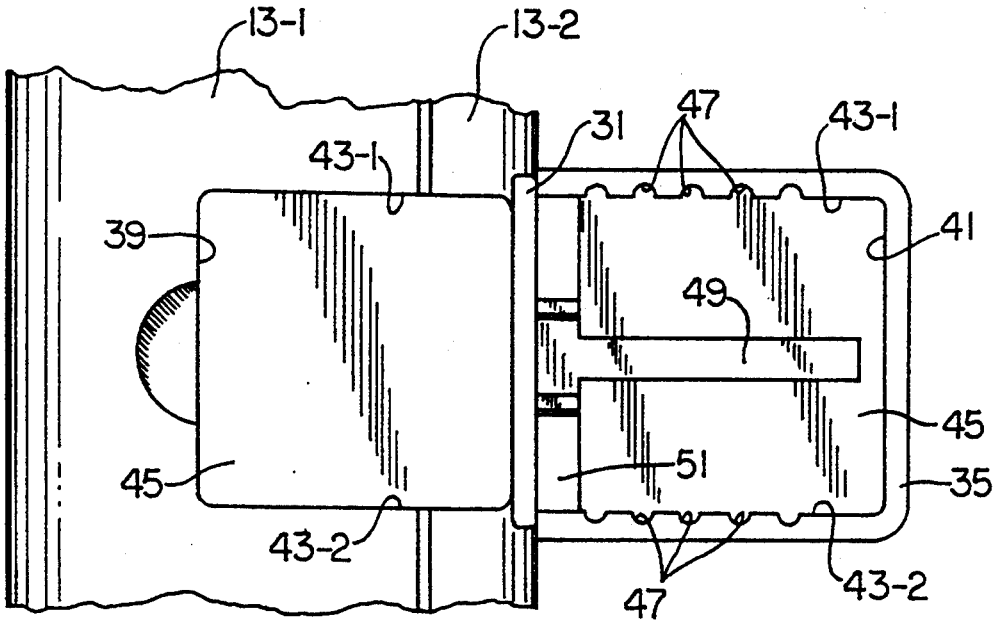
FIG. 3 is an enlarged, fragmentary, top view of the window fan shown in FIG. 2 with the locking clip removed.

The top of housing 13 is also shaped to include an elongated, recessed tray 35. Tray 35 extends transversely below lip 31. A C-shaped clip 37, which will be described below in greater detail, is movably mounted back and forth within tray 35. Tray 35, with clip 37 removed therefrom, can be seen best in FIG. 3. As can be seen, tray 35 is generally rectangular in shape and is defined by a front wall 39, a rear wall 41, a pair of side walls 43-1 and 43-2 and a bottom wall 45. The rearward portions of side walls 43-1 and 43-2 are provided with corresponding sets of evenly-spaced, downwardly-extending grooves 47. As will be discussed below in more detail, grooves 47 are used to receive a pair of spring arms formed on clip 37 in such a way as to lock clip 37 at any one of a plurality of desired positions within tray 35.

Bottom wall 45 is provided with a pair of slots 49 and 51 which intersect in a T-formation. Slot 49, which extends transversely across tray 35, facilitates the insertion and removal of clip 37 into and from tray 35. Slot 51, which extends longitudinally along the rearward portion of tray 35, is used to receive a pair of spring members extending downwardly from the bottom of clip 37 for use in securing clip 37 to tray 35.

Figure 4:
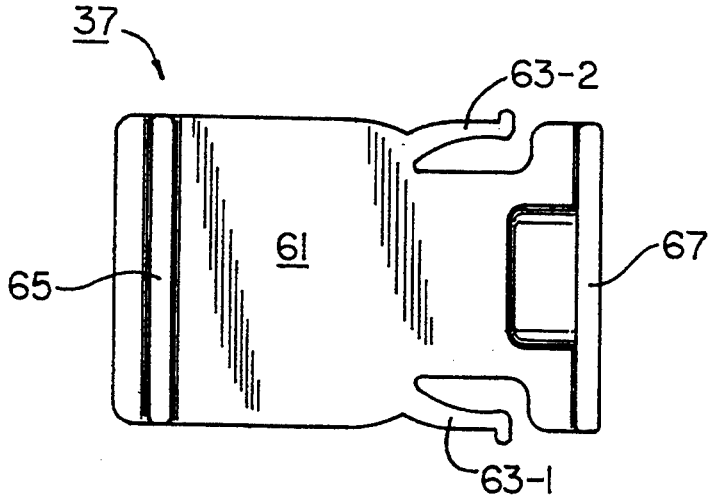
FIG. 4 is an enlarged, top view of the locking clip shown in FIG. 1.
Figure 5:
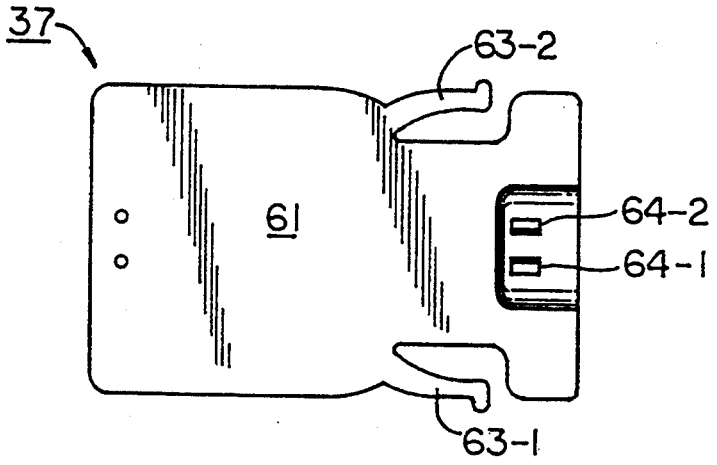
FIG. 5 is an enlarged, bottom view of the locking clip shown in FIG. 1.
Figure 6:
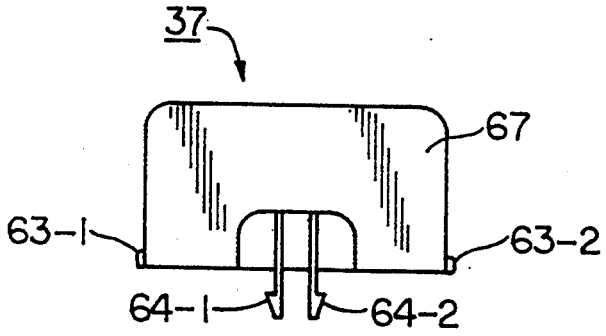
FIG. 6 is an enlarged, rear view of the locking clip shown in FIG. 1.

Referring now to FIGS. 4 through 6, clip 37 is shown in greater detail. As can be seen, clip 37 is a unitary structure, preferably made of molded plastic. Clip 37 is shaped to include an elongated main member 61 having a pair of spring arms 63-1 and 63-2 used to engage an opposing pair of grooves 47 on tray 35. Clip 37 is also shaped to include a pair of downwardly extending spring members 64-1 and 64-2 which are insertable into slot 51 and are used to secure clip 37 to tray 35. Clip 37 is further shaped to include a pair of tabs 65 and 67 which extend vertically upward from opposite ends thereof. As will be seen below, when clip 37 is mounted within tray 35, tab 65 is disposed in front of lip 31 and is adapted to be grasped by a user so that the positioning of clip 37 within tray 35 may be manually adjusted. Tab 67, by contrast, is located rearwardly relative to lip 31 and, as will hereinafter be described, is used in conjunction with lip 31 to mount window fan 11 in a window opening.

Figure 7:
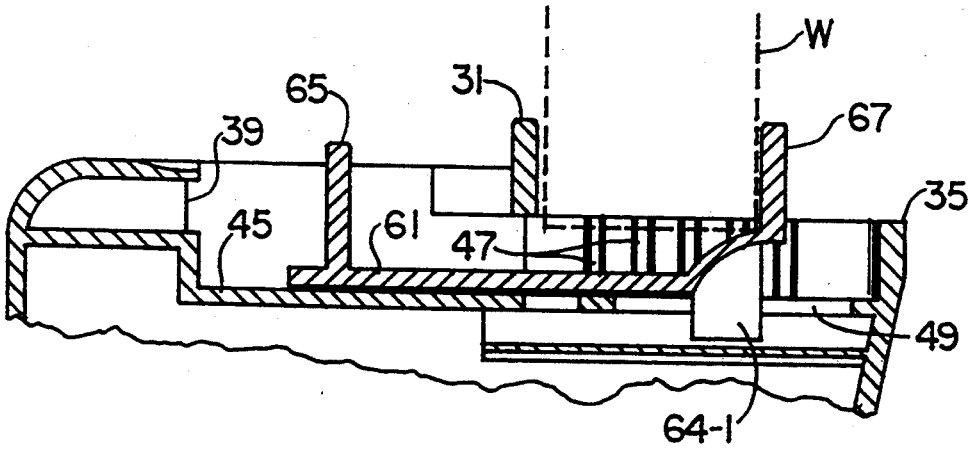
FIG. 7 is an enlarged, fragmentary, section view of the window fan of FIG. 1 shown mounted in a window opening (the window being represented with dotted lines)
Figure 8:
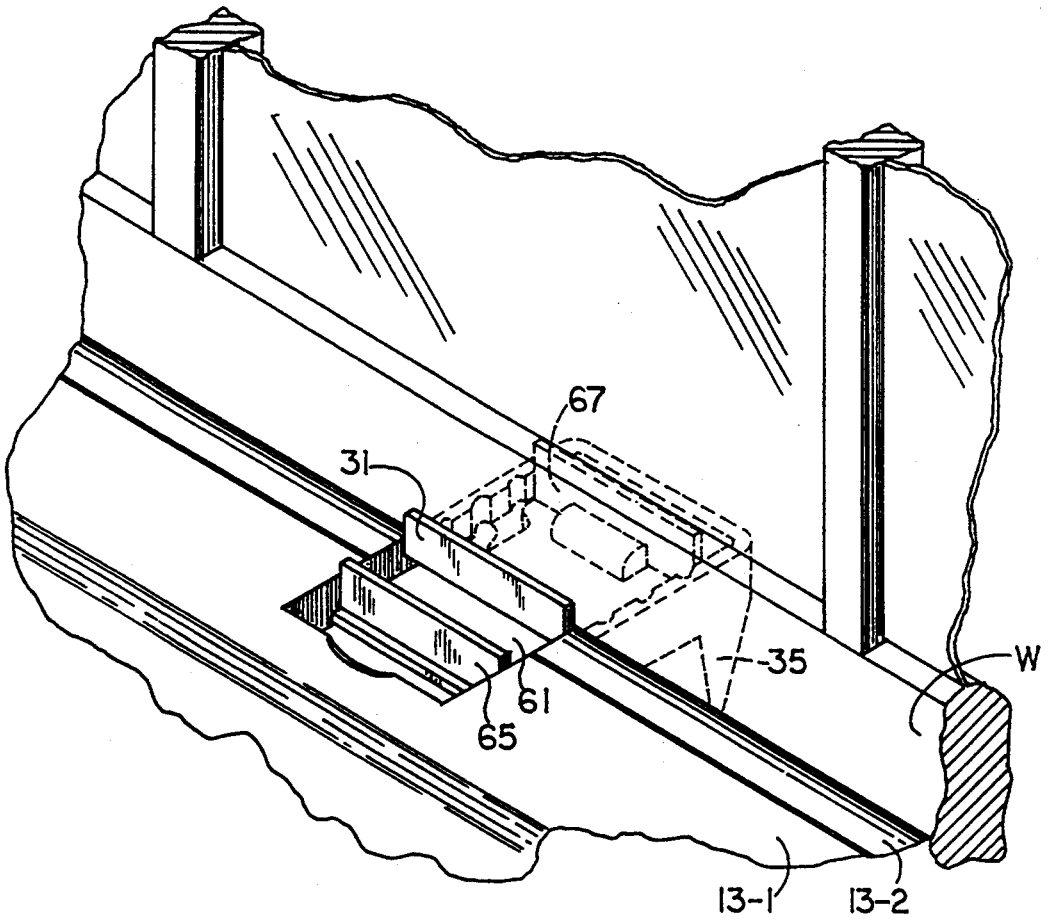
FIG. 8 is an enlarged, fragmentary, top, front, right, perspective view of the window fan of FIG. 1 shown mounted in a window opening.

To mount window fan 11 in a window opening, clip 37 is preferably moved back to one of its rearwardmost orientations within tray 35 and housing 13 is positioned on a window sill so that, when the associated window W is closed thereonto, the front side of window W rests directly behind lip 31. The window W is then closed on top of housing 13, and clip 37 is moved (i.e. ratcheted) forwardly within tray 35 to a position at which the front side of window W is positioned tightly against tab 67 and the rear side of window W is positioned tightly against lip 31. The engagement of arms 63 within a corresponding set of grooves 47 in tray 35 serves to lock clip 37 securely in place. FIGS. 7 and 8 show window fan 11 mounted in this manner within a window opening. (Those portions of window fan 11 shown in dotted lines in FIG. 8 are situated behind window W.)

Figure 9:
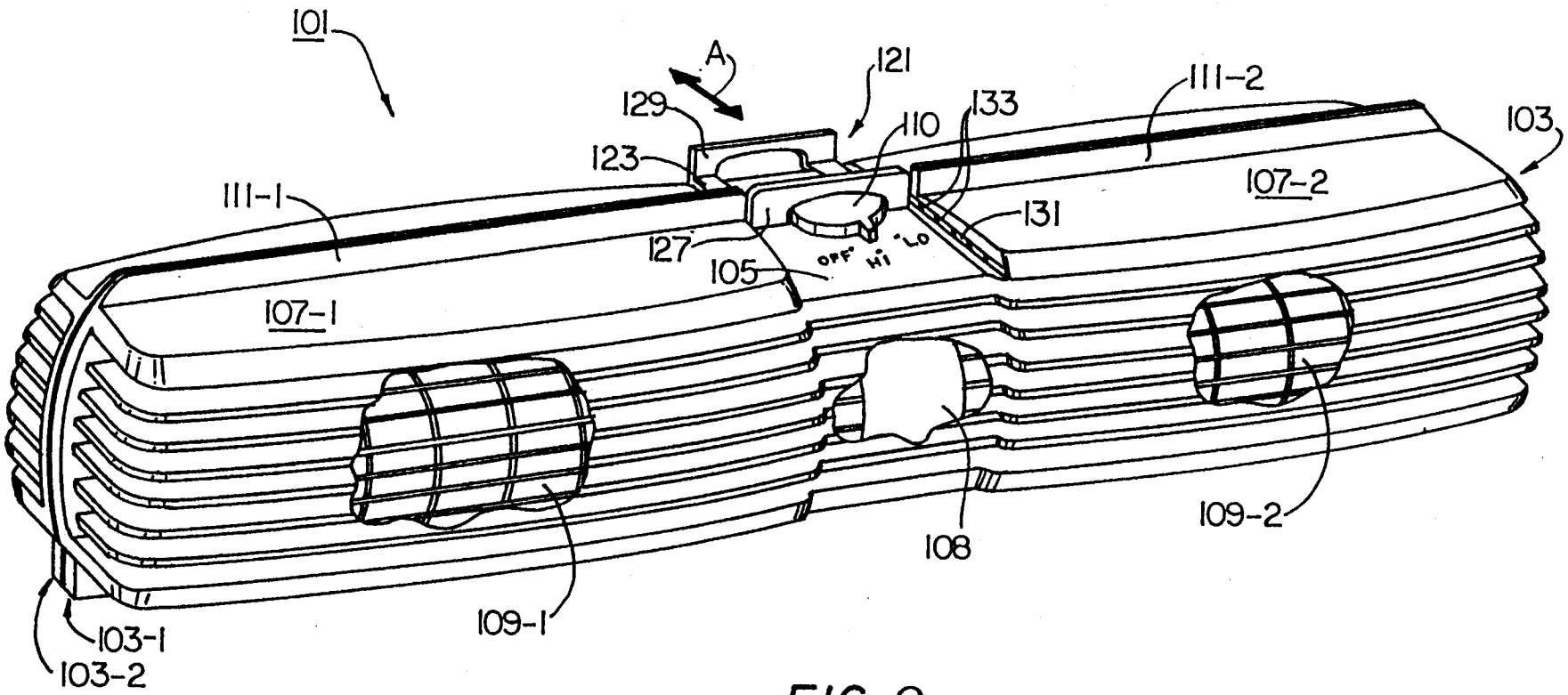
FIG. 9 is a top, front, left, perspective view, broken away in part, of a second embodiment of a window fan constructed according to the teachings of the present invention.
Figure 10:
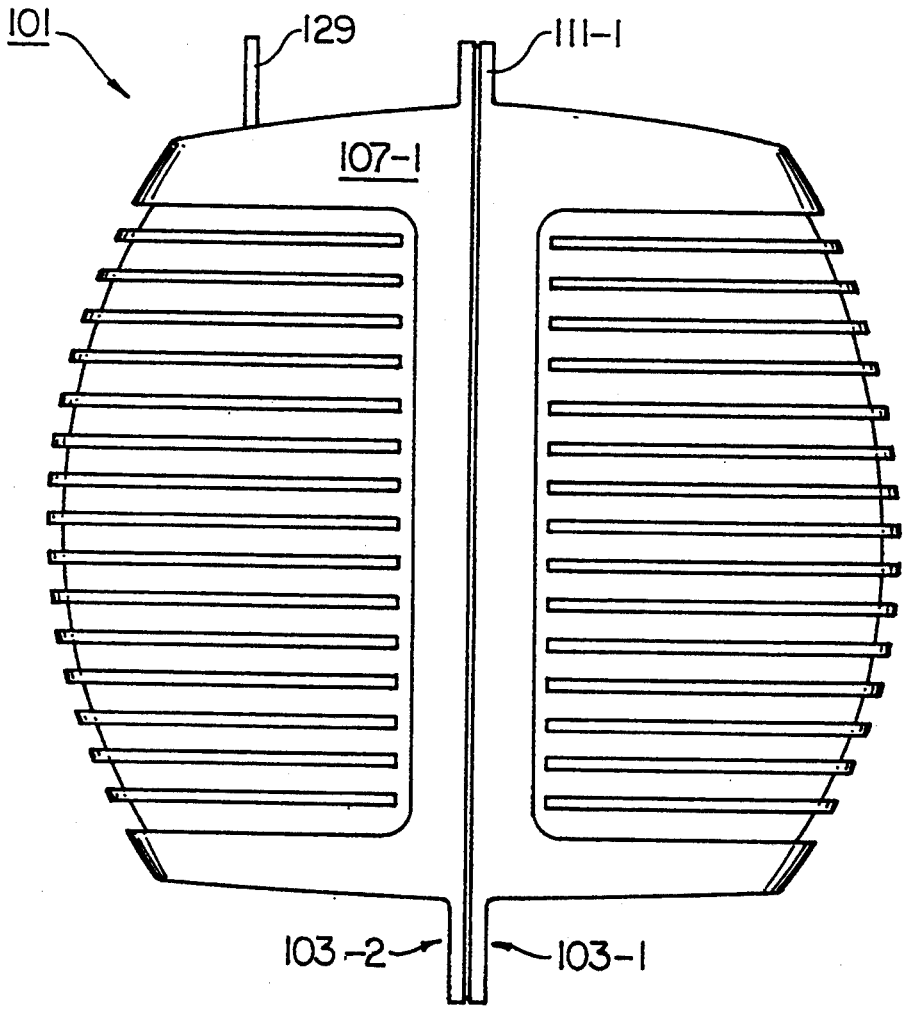
FIG. 10 is a left side view of the window fan shown in FIG. 9.
Figure 11:
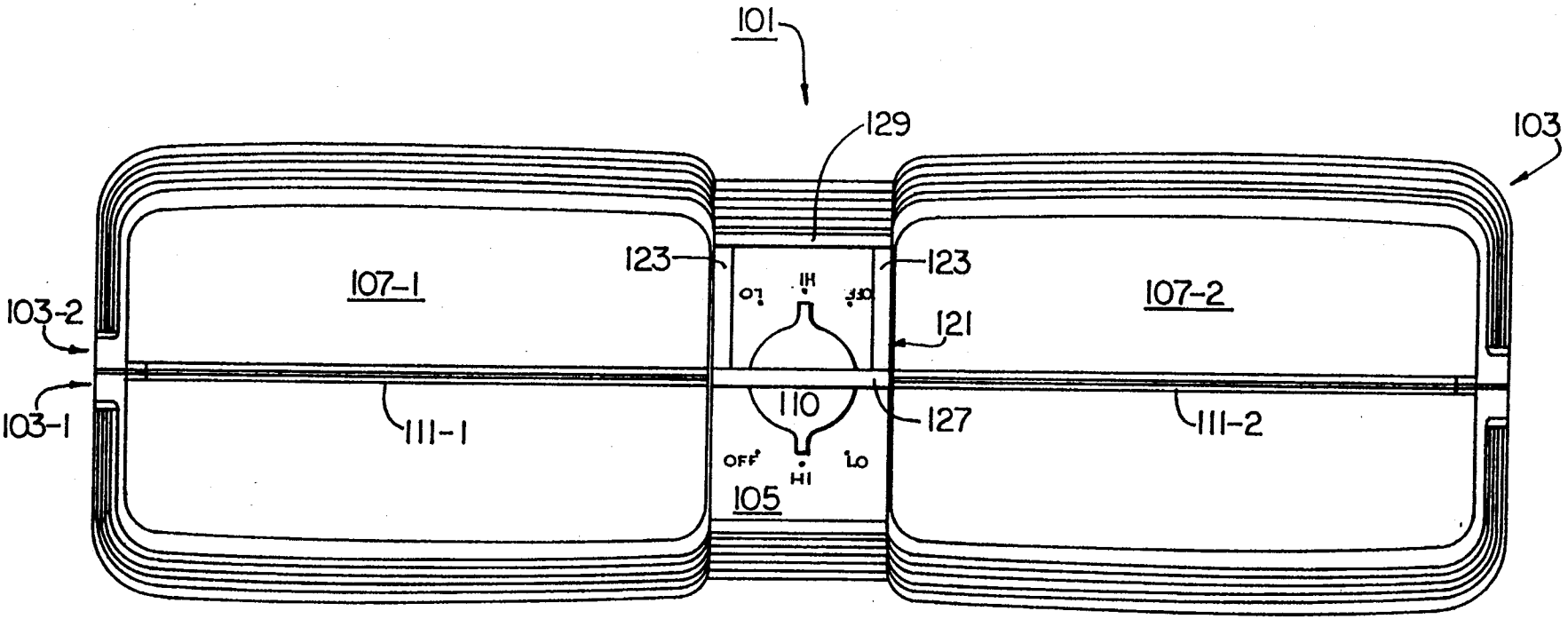
FIG. 11 is a top view of the window fan shown in FIG. 9.

Referring now to FIGS. 9 through 11 there are shown three different views of a second embodiment of a window fan constructed according to the teachings of the present invention, the window fan being represented generally by reference numeral 101. FIG. 9 is a top, front, left, perspective view, broken away in part, of window fan 101, FIG. 10 is a left side view of window fan 101 and FIG. 11 is a top view of window fan 101.

For simplicity, those parts of window fan 101 not pertinent to the invention are not shown or discussed.

Window fan 101 comprises a housing 103. Housing 103, which is preferably made of a front piece 103-1 and a rear piece 103-2 of molded plastic secured together by screws (not shown), is more elongated, rounded and streamlined in appearance than housing 13 and is shaped to define a central section 105 and a pair of lateral sections 107-1 and 107-2. Central section 105 is recessed relative to lateral sections 107-1 and 107-2 on its top and side surfaces and houses an electric motor 108. Lateral sections 107-1 and 107-2 house centrifugal blower fans 109-1 and 109-2, respectively, which are operatively coupled on opposite sides to motor 108. Electricity to motor 108 is supplied by a power cord (not shown) connected in series to a three position (OFF-HI-LO) rotary switch 110 mounted on the top of central section 105.

The top surfaces of lateral sections 107-1 and 107-2 are shaped to include upwardly and longitudinally extending lips 111-1 and 111-2, respectively. For reasons to become apparent below, lips 111-1 and 111-2 are used to abut the front surface of a window which has been closed on top of housing 103.

Figure 12:
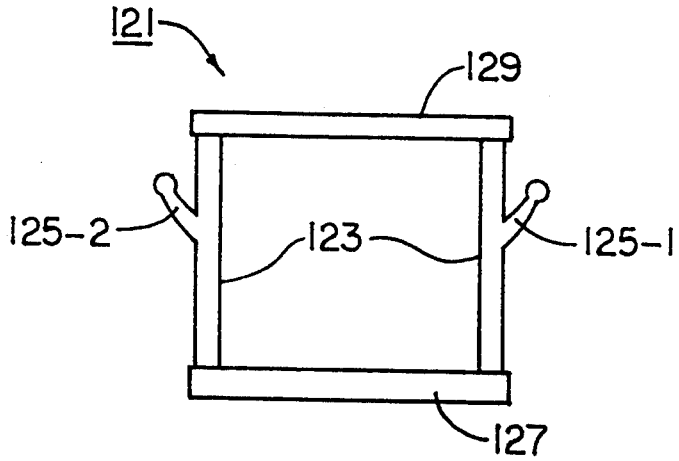
FIG. 12 is a top view of the locking clip shown in FIG. 9.

Window fan 101 also includes a C-shaped clip 121 (shown separately in FIG. 12) mounted on central portion 105 and adapted for back and forth movement thereacross as indicated by double-headed arrow A in FIG. 9. Clip 121 is a unitary structure, preferably made of molded plastic, and is shaped to include a generally rectangular frame-like base member 123. A pair of spring arms 125-1 and 125-2 are disposed on opposite sides of member 123, arms 125-1 and 125-2 being adapted to move within corresponding slots 13 1 formed on facing walls of lateral sections 107-1 and 107-2. Spaced-apart obstructions 133 engageable with spring arms 125-1 and 125-2 are formed in slots 131 for use in locking clip 121 at specific positions in a ratchet-type manner. Clip 121 is also shaped to include a pair of tabs 127 and 129 which extend vertically upward from opposite ends thereof. When clip 121 is mounted on central section 105, tab 127 is disposed in front of lips 111-1 and 111-2 and is adapted to be grasped by a user so that the positioning of clip 121 may be manually adjusted. Tab 129, by contrast, is located rearwardly relative to lips 111-1 and 111-2 and is used in conjunction with lips 111-1 and 111-2 to retain a window therebetween, thereby permitting window fan 11 to be mounted within a window opening.

Window fan 101 may be mounted in a window opening in a similar manner to which window fan 11 may be mounted in a window opening, with lips 111 and tab 129 being cooperatively used to retain the associated window.

It should be noted that window fan 101 is appropriately constructed so that it may be mounted in a window opening with either its front side or rear side facing inwardly (i.e. towards a room). In this manner, window fan 101 may alternatively be used as an exhaust fan or as an intake fan, depending on how it is oriented in the window opening.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A window fan comprising:

a. a housing, said housing being appropriately dimensioned to fit within a window opening and having an integrally formed lip adapted to abut one side of a window which has been closed onto said housing;

b. a fan unit mounted within said housing; and c. a clip slidably mounted on said housing, said clip including a tab adapted to abut the opposite side of a window which has been closed onto said housing and means lockingly engageable with said housing for locking said tab in a locked position in which the window is securely retained between said lip and said tab.

2. The window fan as claimed in claim 1 wherein said housing is generally box-like in shaped and is dimensioned for double-hung windows.

3. The window fan as claimed in claim 2 wherein said fan unit comprises an electric motor and a propeller-type fan blade rotably mounted on said electric motor.

4. The window fan as claimed in claim 1 wherein said housing is shaped to include a central section and a pair of lateral sections, said central section being recessed relative to said lateral sections at least along its top, said clip being mounted on top of said central portion of said housing.

5. The window fan as claimed in claim 4 wherein said fan unit comprises an electric motor and a pair of centrifugal blower fans coupled to said electric motor, said electric motor being disposed within said central portion of said housing, one of said pair of centrifugal blower fans being disposed in each of said lateral portions of said housing.

6. The window fan as claimed in claim 5 wherein said lip is formed along each of said lateral portions of said housing.

7. The window fan as claimed in claim 6 wherein said clip is shaped to include a pair of spring arms and wherein said lateral portions of said housing are shaped to include a corresponding pair of slots for receiving said spring arms, said slots being provided with obstructions to lock said spring arms within said slots in a ratchet-type fashion.

8. The window fan as claimed in claim 7 wherein said clip also includes a second tab adapted to be grasped by a user for use in moving said clip.

9. The window fan as claimed in claim 1 wherein said housing and said clip are constructed so that said window fan may be mounted in a window opening with the front of said housing either facing towards the interior of a room or away from the interior of a room.

10. A window fan comprising.:

a. housing, said housing, being appropriately dimensioned to fit within a window opening and having a lip formed along a portion of the top of said housing, said lip being adapted to abut one side of a window which has been closed onto said housing, said housing also being shaped to include a recessed tray extending transversely below said lip;

b. a fan unit mounted within said housing; and c. a clip slidably mounted within said recessed tray, said clip including a tab adapted to abut the opposite side of a window which has been closed onto said housing and being movable to a locked position in which the window is securely retained between said lip and said tab.

11. The window fan as claimed in claim 10 wherein said clip is shaped to include at least one spring arm and wherein said recessed tray is shaped to include a groove adapted to lockingly receive said spring arm.

12. The window fan as claimed in claim 10 wherein said clip is shaped to include at least one spring arm and wherein said recessed tray is shaped to include a plurality of spaced-apart grooves adapted to lockingly receive said spring arm in a ratchet-type fashion.

13. A window fan comprising:

a. a housing, said housing being appropriately dimensioned to fit within a window opening and having an integrally formed lip adapted to abut one side of a window which has been closed onto said housing;

b. a fan unit mounted within said housing; and c. a clip slidably mounted on said housing, said clip being C-shaped and including a first tab, said first tab being adapted to abut the opposite side of a window which has been closed onto said housing and being movable to a locked position in which the window is securely retained between said lip and said first tab, a second tab, said second tab being adapted to be grasped by a user for use in moving said first tab into said locked position and means lockingly engageable with said housing for locking said first tab in said locked position.

14. A device for securing a housing within a window opening, the housing having an integrally formed lip adapted to abut one side of a window which has been closed onto said housing, said device comprising a C-shaped clip slidably mounted on said housing, said C-shaped clip being a unitary structure and including a first tab movable to a locked position in which said first tab abuts the opposite side of a window which has been closed onto said housing in such a way as to retain the window between said lip and said first tab, a second tab adapted to be grasped by a user for use in moving said first tab to said locked position and means lockingly engageable with said housing for locking said first tab in said locked position.

* * * * *